US009133639B2

(12) United States Patent
Ben-Dov et al.

(10) Patent No.: US 9,133,639 B2
(45) Date of Patent: Sep. 15, 2015

(54) POOL CLEANING ROBOT

(75) Inventors: Boaz Ben-Dov, Yizrael (IL); Evgeny Blank, Toronto (CA)

(73) Assignee: MAYTRONICS LTD., Kibutz Yizrael (IL)

( * ) Notice: Subject to any disclaimer, the term of this patent is extended or adjusted under 35 U.S.C. 154(b) by 216 days.

(21) Appl. No.: 13/584,837

(22) Filed: Aug. 14, 2012

(65) Prior Publication Data

US 2013/0061407 A1 Mar. 14, 2013

(30) Foreign Application Priority Data

Sep. 13, 2011 (IL) ..... 215115

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
CPC ..... E04H 4/1654; E04H 4/1636
USPC ..... 15/1.7; 210/167.15, 167.16, 167.17, 210/416.2
See application file for complete search history.

(56) References Cited

U.S. PATENT DOCUMENTS 4,168,557 A * 9/1979 Rasch et al. ..... 15/1.7
5,404,607 A * 4/1995 Sebor ..... 15/1.7
5,567,315 A * 10/1996 Weidenmann et al. ..... 210/123
5,585,010 A * 12/1996 Dockery et al. ..... 210/805
5,725,761 A * 3/1998 Phillips ..... 210/167.11
6,039,886 A * 3/2000 Henkin et al. ..... 210/776
6,886,205 B1 * 5/2005 Pichon ..... 15/1.7
8,273,183 B2 * 9/2012 Erlich et al. ..... 134/6
8,307,484 B2 * 11/2012 Porat ..... 15/1.7
8,307,485 B2 * 11/2012 Sumonthee ..... 15/1.7
8,696,821 B2 * 4/2014 Erlich et al. ..... 134/18
8,709,243 B2 * 4/2014 Hui ..... 210/167.11
2007/0028405 A1 * 2/2007 Garti ..... 15/1.7
2008/0235887 A1 * 10/2008 Horvath et al. ..... 15/1.7
2009/0282627 A1 * 11/2009 Porat ..... 15/1.7
2011/0067729 A1 * 3/2011 Erlich et al. ..... 134/6
2011/0154585 A1 * 6/2011 Mastio et al. ..... 15/1.7
2011/0203060 A1 * 8/2011 Pichon et al. ..... 15/1.7
2012/0103365 A1 * 5/2012 Sumonthee ..... 134/18

* cited by examiner

*Primary Examiner* — Monica Carter
*Assistant Examiner* — Michael Jennings
(74) *Attorney, Agent, or Firm* — Reches Patents

(57) ABSTRACT

A pool cleaning robot comprising: a housing; an impeller and a motor; at least one filter compartment configured for accommodating a filter unit therein; an impeller outlet formed in a housing top surface; at least one additional outlet other than the impeller outlet configured for being fluidly connected to an external suction and filtering system; at least one bottom inlet formed in said housing bottom configured for a first fluid communication with the impeller outlet via said filter unit, thereby defining a first fluid path; and at least one bottom inlet formed in said housing bottom configured for a second fluid communication with said additional outlet via a second fluid path at least partially different from the first fluid path, said second fluid path constituting a part of an external suction and filtering fluid path created when said additional outlet is fluidly connected to an external suction and filtering system.

16 Claims, 10 Drawing Sheets

POOL CLEANING ROBOT

RELATED APPLICATIONS

This application claims priority from Israeli Patent Application serial number 215115, titled "POOL CLEANING ROBOT", filing date Sep. 13, 2011, which is incorporated herein by reference.

TECHNICAL FIELD

This invention relates to devices for cleaning swimming pools, basins, and the like. More particularly, the invention relates to an electric robot being able to clean the swimming pool automatically.

BACKGROUND DESCRIPTION

Different types of pool cleaning robots exist, and particularly known are cleaning robots whose suction is connected to the suction device of the pool filtration system and depends on the latter, and cleaning robots equipped with a pump that is independent in relation to the pool filtration system.

A robot that uses the filtration system of the pool is disclosed for example in US patent application US2009/307854. A robot that is equipped with a pump and has an internal filtration system is disclosed for example in US patent application US2007/028405.

There is also one example of a pool cleaning robot that is marketed under the name WEDA B680. This robot has an internal pump and a filter bag which is connectable to its impeller outlet. This robot can also be connected to an external filtration system such as the filtration system of the pool by removing the filter bag, and directing the impeller outlet to be filtered by the external filtration system.

SUMMARY OF THE PRESENTLY DISCLOSED SUBJECT MATTER

The presently disclosed subject matter provides a pool cleaning robot which can filter the water of the pool by using of an internal or an external suction and filtering system, according to different needs and parameters (e.g., the type of the debris in the water, time, and availability of the filtering systems).

In accordance with one aspect of the presently disclosed subject matter, there is provided a pool cleaning robot, comprising: a housing having a housing bottom and a housing top surface; an impeller and a motor configured to operate the impeller, both mounted within the housing; at least one filter compartment formed within the housing configured for accommodating a filter unit therein; an impeller outlet formed in the housing top surface; at least one additional outlet other than the impeller outlet formed in the housing top surface and configured for being fluidly connected to an external suction and filtering system; at least one bottom inlet formed in the housing bottom configured for a first fluid communication with the impeller outlet via the filter unit, thereby defining a first fluid path; and at least one bottom inlet formed in the housing bottom configured for a second fluid communication with the additional outlet via a second fluid path at least partially different from the first fluid path. The second fluid path constitutes a part of an external suction and filtering fluid path created when the additional outlet is fluidly connected to an external suction and filtering system.

The term 'external suction and filtering system' refers hereinafter to any known in the system which is able to pump fluid and filter it. This system can be, for example, a filtering system of a swimming pool (e.g., standard pool filtering systems, biological filtering system), or any other filtering system located outside the robot. According to the presently disclosed subject matter, the external suction and filtering system can be configured to pump water with debris via the robot, and filter this water. The external suction and filtering system can be constructed of two separate systems: a suction system and a filtering system which can be fluidly connected to each other.

The bottom inlet of the first fluid path can constitute the bottom inlet of the second fluid path. The robot can further comprise an arrangement for selecting or mixing between the first fluid communication and the second fluid communication.

The filter compartment can be configured to accommodate an adapter unit having an interior portion which constitutes a part of the second fluid path.

The interior portion of the adapter unit can be disposed between a first and a second end of the adapter unit. The first end of the adapter unit can be configured for fluidly communicating with the bottom inlet of the second fluid path, and the second end of the adapter unit can be configured for fluidly communicating with the additional outlet.

The arrangement for selecting or mixing between the first fluid communication and the second fluid communication can be provided by the filter unit and the adapter unit being interchangeably accommodated within the filter compartment. The arrangement can further provided by the additional outlet being configured for being opened and closed for allowing and preventing the second fluid communication, respectively. The robot can further comprise a hose adapter configured for fluidly connecting the additional outlet to a hose connectable to the external suction and filtering system. The external suction and filtering fluid path can further be defined by this hose. The hose adapter can include a swivel mechanism configured for preventing swivel of said hose around itself.

The robot can be operated by an electric supply source via an electric cable. The robot can comprise at least one holder configured for holding the electric cable and the hose in proximity to each other and preventing their swivel around each other. The holder can comprise: an aperture for allowing insertion of said cable therethrough and free rotation of said cable therein; and a grasper configured for detachably attaching to the hose.

The robot can further comprise at least one additional inlet formed in the housing top surface and configured for a third fluid communication with the impeller outlet, thereby defining a third fluid path. The third fluid communication can be configured to generate a thrust force that biases the housing toward a pool surface which the housing bottom faces during operation of the robot.

The first fluid communication can also be configured to generate a thrust force that biases the housing toward a pool surface which the housing bottom faces during operation of the robot. The robot is configured for climbing of a sidewall of the pool during operation of the robot via the first fluid path, and during operation of the robot via a combination of the second and the third fluid paths, when the biasing contributes to the robot to be in contact with the sidewall of the pool.

The robot can be configured to be operated via the second and the third fluid communications, simultaneously. The arrangement for selecting or mixing between the first and a combination of the second with the third fluid paths can be provided by the additional inlet which is configured for being opened and closed for allowing and preventing said third fluid communication, respectively.

The additional inlet and outlet can be disposed at a common opening formed within the housing top surface.

The common opening can comprise a door configured for allowing and preventing the second and third fluid communication by being opened and closed, correspondingly. The additional inlet can be formed at the common opening around the additional outlet.

The bottom inlet of the first fluid path can constitute the bottom inlet of the second fluid path, and the filter unit can have a filter unit interior at least a part of which can be configured to constitute at least a part of the first and the second fluid paths, while the third fluid path is obstructed (if it exists).

The filter unit can comprise a filter unit opening configured to fluidly communicate between the filter interior and the additional outlet.

The fluid communication between the filter interior and the additional outlet can be configured to allow extraction of debris from the filter interior via the second fluid path.

The first and second fluid paths can be operative simultaneously, during the operation of the robot.

The first and second fluid paths can be operative independently from each other.

The robot can comprise a driving unit having at least one electric motor configured for moving the robot within the pool. The driving unit can be operated by an electric supply source, and can comprise a main controller configured to control the operation of the motor during operation of the robot via the first fluid path, and during operation of the robot via a combination of the second and the third fluid paths.

The at least one bottom inlet can constitute at least a first and a second bottom inlet, one of which is sealable for fluid communication by a sealing member when the second and third fluid communications are selected.

According to an additional aspect of the presently disclosed subject matter, there is provided a pool cleaning robot, comprising: a housing having a housing bottom and a housing top surface; an impeller and a motor configured to operate the impeller, both mounted within the housing; an impeller outlet formed in the housing top surface; at least one bottom inlet formed in the housing bottom configured for a first fluid communication with the impeller outlet via the filter unit, thereby defining a first fluid path; and at least one additional inlet formed in the housing top surface and configured for a third fluid communication with the impeller outlet, thereby defining a third fluid path. The first and the third fluid communications can be configured to generate a thrust force that biases the housing toward a pool surface which the housing bottom faces during operation of the robot.

According to an additional aspect of the presently disclosed subject matter, there is provided a pool cleaning robot, comprising: a housing having a housing bottom and a housing top surface; an impeller and a motor configured to operate the impeller, both mounted within the housing; a first and a second filter compartments formed within the housing, each configured for accommodating a filter unit therein; the motor being disposed between the first and second filter compartments; an impeller outlet formed in the housing top surface; an additional outlet other than the impeller outlet formed in the housing top surface proximal to the first filter compartment and configured for being fluidly connected to an external suction and filtering system; and a first and a second bottom inlets formed in the housing bottom, each configured to be in fluid communication with the first and the second filter compartments and configured for a first fluid communication with the impeller outlet via the filter units, thereby defining a first fluid path. The first bottom inlet can be configured for a second fluid communication with the additional outlet via a second fluid path at least partially different from the first fluid path. The second fluid path can constitute a part of an external suction and filtering fluid path created when the additional outlet is fluidly connected to an external suction and filtering system.

The robot can comprise an additional inlet formed in the housing top surface and configured for a third fluid communication with the impeller outlet, thereby defining a third fluid path. The third fluid communication can generate a thrust force that biases the housing toward a pool surface adjacent to the housing bottom. The first fluid communication can also generate a thrust force that biases the housing toward a pool surface adjacent to the housing bottom.

The robot can further comprise an arrangement for selecting or mixing between the first and a combination of the second with the third fluid communications. The arrangement can be provided by the additional outlet being configured for being opened and closed for allowing and preventing said second fluid communication, respectively.

The additional inlet and outlet can be disposed at a common opening formed within the housing top surface. The common opening can comprise a door configured for allowing and preventing the second and third fluid communications, by being opened and closed, correspondingly. The additional inlet can be formed at the common opening around the additional outlet.

The first filter compartment can be configured to accommodate an adapter unit having an interior portion which constitutes a part of the second fluid path.

The interior portion of the adapter unit can be disposed between a first and a second end of the adapter unit. The first end of the adapter unit can fluidly communicate with the first bottom inlet, and the second end of the adapter unit can fluidly communicate with the additional outlet.

The arrangement for selecting or mixing between the first fluid communication and the second fluid communication can be provided by the filter unit and the adapter unit being interchangeably accommodated within the filter compartment.

The robot can further comprise a hose adapter configured for fluidly connecting the additional outlet to a hose connectable to the external suction and filtering system. The hose adapter can include a swivel mechanism configured for preventing swivel of said hose around itself.

The robot can be operated by an electric supply source via an electric cable. The robot can comprise at least one holder configured for holding the electric cable and the hose in proximity to each other and preventing their swivel around each other. The holder can comprise: an aperture for allowing insertion of said cable therethrough and free rotation of said cable therein; and a grasper configured for detachably attaching to the hose.

According to an additional aspect of the presently disclosed subject matter, there is provided a kit for cleaning a pool, comprising a pool cleaning robot, an adapter unit, and a hose. The pool cleaning robot comprising: a housing having a housing bottom and a housing top surface; an impeller and a motor configured to operate the impeller, both mounted within the housing; at least one filter compartment formed within the housing configured for accommodating a filter unit and the configured for accommodating the adapter unit therein; an impeller outlet formed in the housing top surface; at least one additional outlet other than the impeller outlet formed in the housing top surface and configured for being fluidly connected to an external suction and filtering system via the hose; at least one bottom inlet formed in the housing bottom configured for a first fluid communication with the impeller outlet via the filter unit, thereby defining a first fluid path; and at least one bottom inlet formed in the housing bottom configured for a second fluid communication with the additional outlet via a second fluid path at least partially different from the first fluid path and via the adapter unit, the second fluid path constituting a part of an external suction and filtering fluid path created when the additional outlet is fluidly connected to an external suction and filtering system via the hose.

According to an additional aspect of the presently disclosed subject matter, there is provided a pool cleaning robot being operated by an electric supply source via an electric cable and connected to an external suction and filtering system via a hose, comprising at least one holder configured for holding the electric cable and the hose in proximity to each other and preventing their swivel around each other.

The holder can comprise: an aperture for allowing insertion of the cable therethrough and free rotation of the cable therein; and a grasper configured for detachably attaching to the hose.

BRIEF DESCRIPTION OF THE DRAWINGS

In order to understand the invention and to see how it can be carried out in practice, embodiments will now be described, by way of non-limiting examples only, with reference to the accompanying drawings, in which.

DETAILED DESCRIPTION OF EXAMPLES

The presently disclosed subject matter discloses a pool cleaning robot which is configured for cleaning a surface and/or water of a pool by providing an ability to use one of two types of filtering systems: an internal filtering system and an external suction and filtering system. Each of these filtering systems has its own advantage over the other one, and can be chosen for cleaning the pool according to various circumstances such as the type and the amount of debris in the water, and the type of the pool (e.g., a regular pool, a biological pool). For example, if the pool has debris (e.g., leaves, parts of vegetation) that can at least partially obstruct an internal filter (which constitutes a part of the internal filtering system), the external suction and filtering system can be chosen. This can be important, for example in biological pools. Alternatively, when simple cleaning of the pool is needed, the use of the internal filtering system may be preferable. This type of filtering system may be more economical, less complicated, and much simpler for operation.

Figure 1:
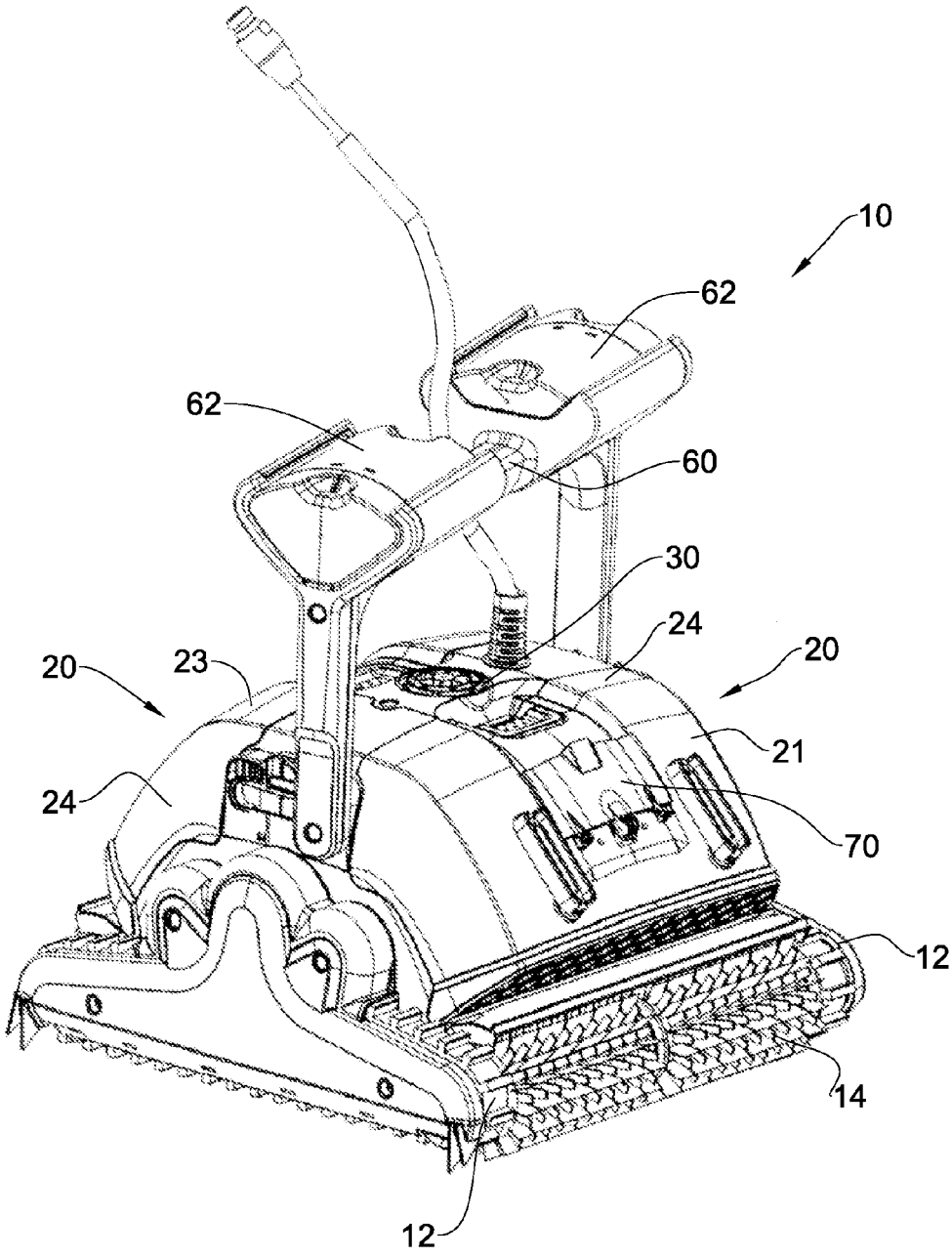
FIG. 1 schematically illustrates a perspective view of a pool cleaning robot according to the presently disclosed subject matter, when its internal filtering system can be used.
Figure 2:
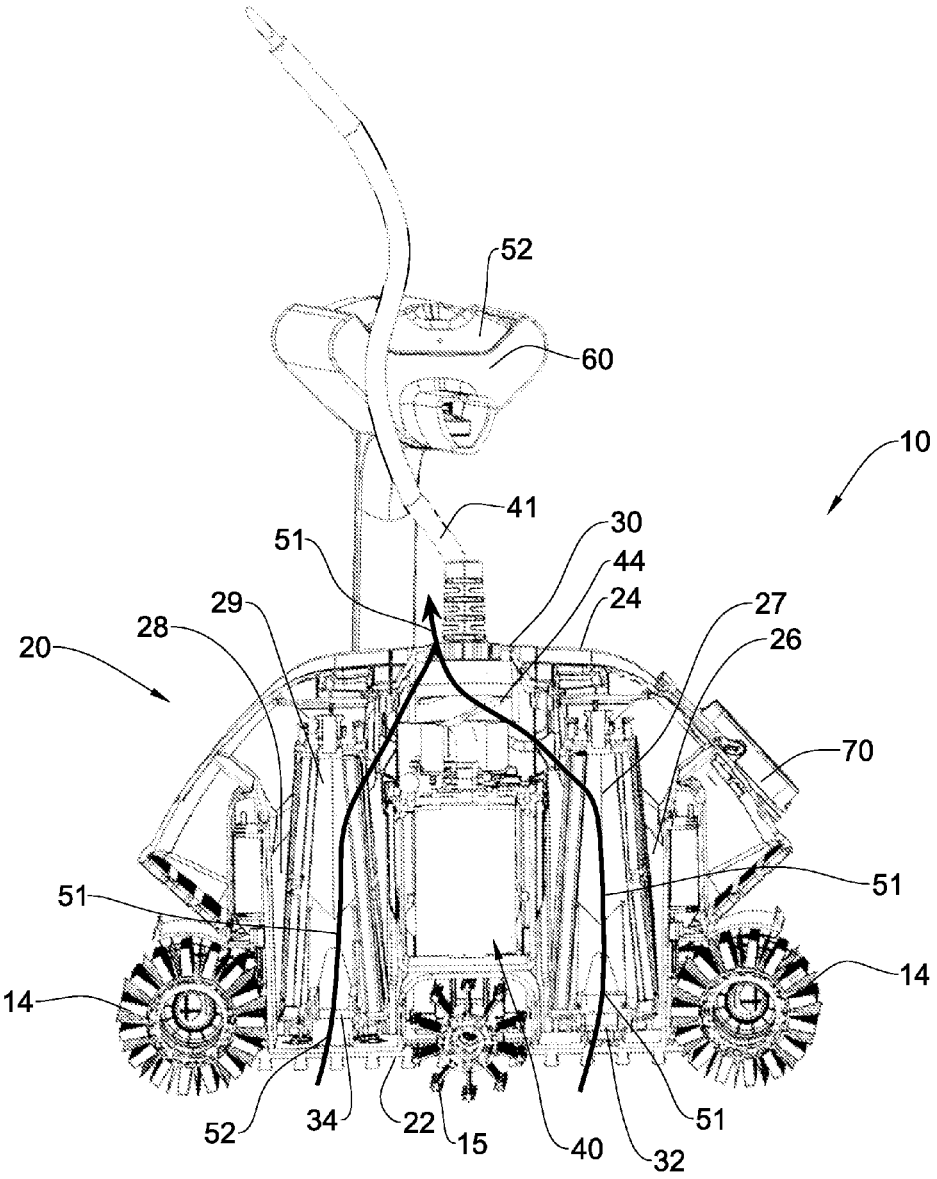
FIG. 2 schematically illustrates a cross-sectional view of a pool cleaning robot according to the presently disclosed subject matter, when its internal filtering system can be used.
Figure 3:
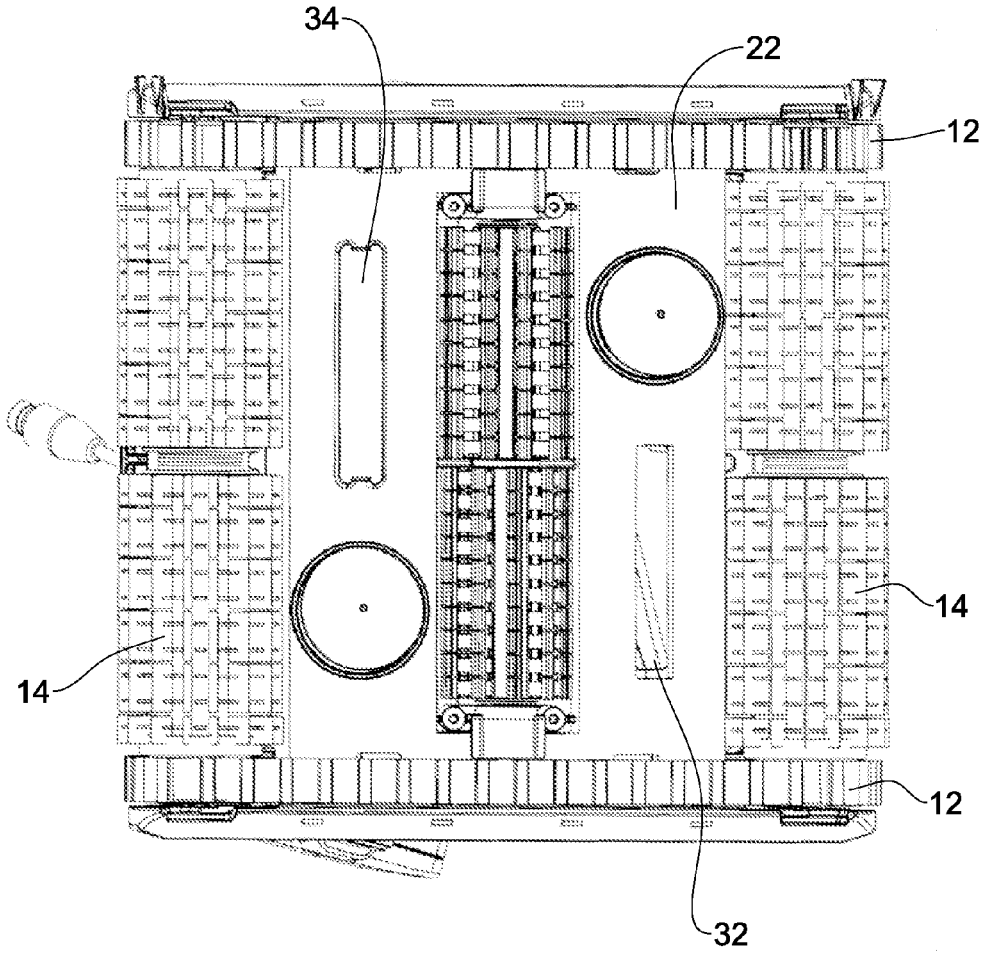
FIG. 3 schematically illustrates a bottom view of a pool cleaning robot according to the presently disclosed subject matter, when its internal filtering system can be used.

As illustrated in FIGS. 1 to 3, there is provided a pool cleaning robot, which is generally indicated at 10. The robot 10 of FIGS. 1 to 3 is configured to clean the pool by using an internal filter system, as it is explained below. The robot 10 comprises a housing 20 which has a housing bottom 22 and a housing top surface 24 having a first cover 21 and a second cover 23, and a driving unit 40 having an impeller 44 which is connected to an impeller motor (not shown) that rotates the impeller in operation. The driving unit 40 also includes two motors 42 (shown in FIG. 6) configured to move the robot within the swimming pool by rotating right and left movement belts 12, correspondingly.

According to other example, the impeller motor and the motors 42 can be the same motor which uses transition system for simultaneously operating the impeller and the motors 42.

The housing 20 also includes a first filter compartment 26 and a second filter compartment 28 formed therein, such that the driving unit 40 is disposed therebetween. As shown in FIG. 2, each of the filter compartments 26 and 28 accommodates a first filter unit 27 and a second filter unit 29, correspondingly. The first and the second filter units 27 and 29 constitute a part of the internal filtering system by filtering the pool's water which passes therethrough while being pumped by the impeller 44. The filter units 27 and 29 are made of a rigid frame, and can be extracted from the robot 10 for cleaning, replacement, and for using the external suction and filtering system instead of the internal filtering system.

In addition, the robot 10 comprises a handle 60 which contains two floats 62 for maintaining a balanced position during use on a pool's floor, and a balanced position when cleaning at the waterline.

The driving unit 40 is sealably disposed within the housing 20, and can be operated by being connected to an electric power source (not shown) via an electric cable 41. The driving unit 40 also includes a main controller (not shown) which can be programmed to control the operation of the robot, and specifically the operation of the motor 42. For example, the main controller can be programmed to perform scanning of the pool according to one of several algorithms.

The robot 10 further includes movement belts 12 which are driven by the motor 42, two main brushes 14 and an auxiliary brush 15 therebetween all connected to the movement belts 12 and operable by the motor 42, so that in operation, an impeller motor of the driving unit 42 rotates the impeller 44 for generating suction of water from the robot 10 and simultaneously the motors 42 rotate the movement belts 12 and the main brushes 14 connected thereto.

The housing 10 further includes an impeller outlet 30 which is formed in the housing top surface 24, and a first and second bottom inlets 32 and 34 which are formed in the housing bottom 22. As shown in FIG. 3, the first and the second bottom inlets 32 and 34 are in fluid communication with the first and the second filter compartments 26 and 28, and with the first and the second filter units 27 and 29, correspondingly. In the configuration of the robot 10 according to FIGS. 1 to 3, in which the internal filtering system is used, the first and the second bottom inlets 32 and 34 are in a first fluid communication with the impeller outlet 30 via the first and the second filter units 27 and 29, correspondingly, thereby defining a first fluid path 51 (shown in FIG. 2).

During operation of the robot 10, when the internal filtering system is used, the impeller 44 which is operated by the impeller motor, draws water and debris from the floor or sidewall of the pool via the first fluid path, i.e., from the first and the second water inlets 32 and 34 through the first and the second filters 27 and 29 towards the impeller outlet 30. The clean water is expelled through the impeller outlet 30. In addition to facilitating the cleaning of the pool, this process generates a thrust force that biases the robot 10 toward the surface of the pool. This thrust force keeps the robot proximal to the pool's surface to as to clean the pool's floor and to climb on the pool's wall and clean it. This operation is generally similar to the operation of known electrically powered robots, which have internal filtering system, such as the robots which are disclosed in US2009/0045110 and in US2010/0306931. As disclosed above, simultaneously to the operation of the impeller 44 by the impeller motor, the motors 42 rotate the movement belts 12 which rotate the two main brushes 14 and the auxiliary brush 15. This provided to the robot 10 the ability to move and to clear the pool's surface by the brushes.

In addition to the ability of the robot 10 to clean the pool by its internal filtering system, the robot is able to clean the pool by using an external suction and filtering system, as it described below with reference to FIGS. 4 to 8.

Figure 4:
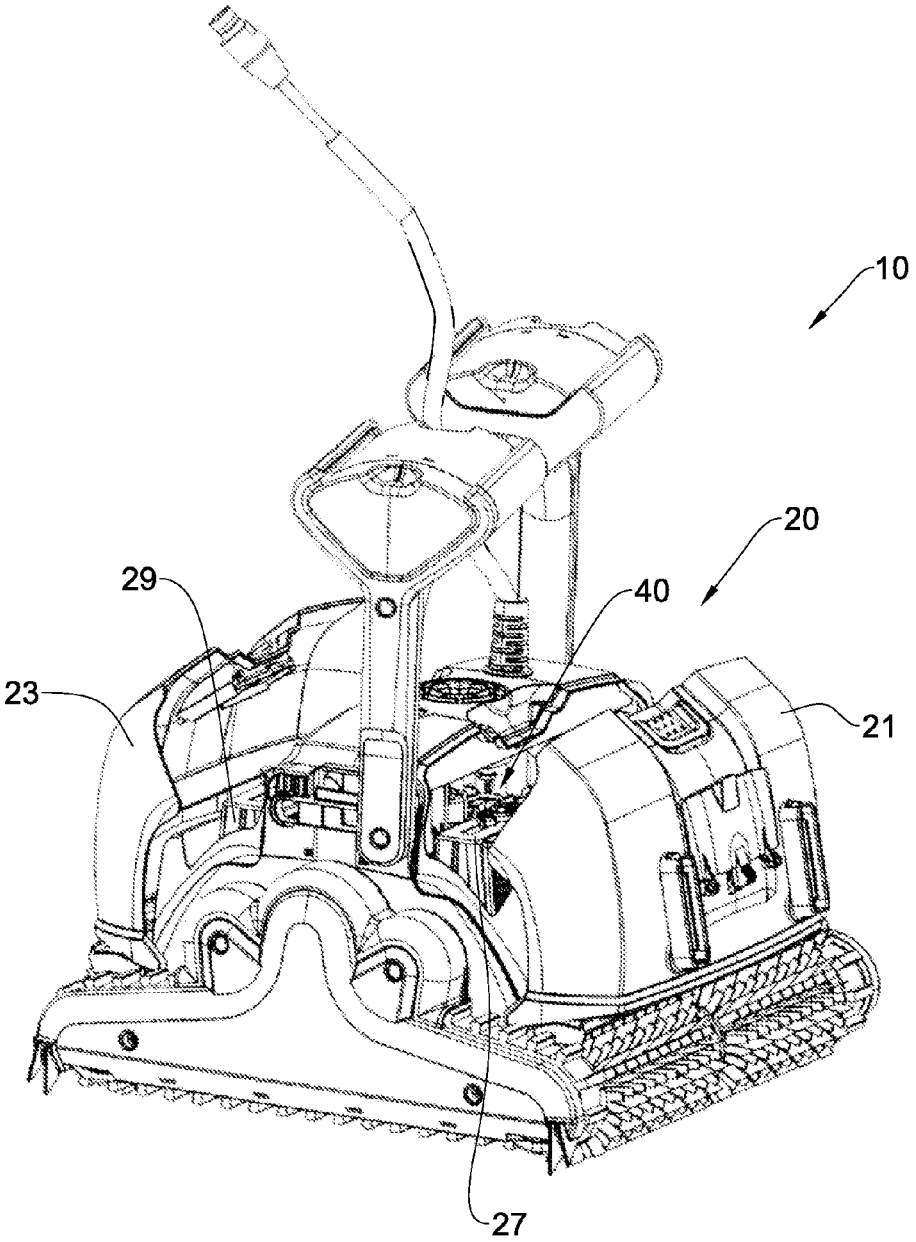
FIG. 4 schematically illustrates a perspective view of a pool cleaning robot according to the presently disclosed subject matter, when its housing top surface is opened for extraction of filter unit therefrom.

As shown in FIG. 4, in order to clean the pool by an external suction and filtering system (not shown), which can be the filtering system of the pool (e.g., standard pool filtering systems, biological filtering system), or any other filtering system located outside the housing 20, at the first step, the first and second covers 21 and 23 can be pivotally opened so as to extract the filter units 27 and 29 out of their filter compartment 26 and 28, correspondingly. The connection of the robot 10 to the external suction and filtering system and its operation when connected to this system are detailed below.

Figure 5:
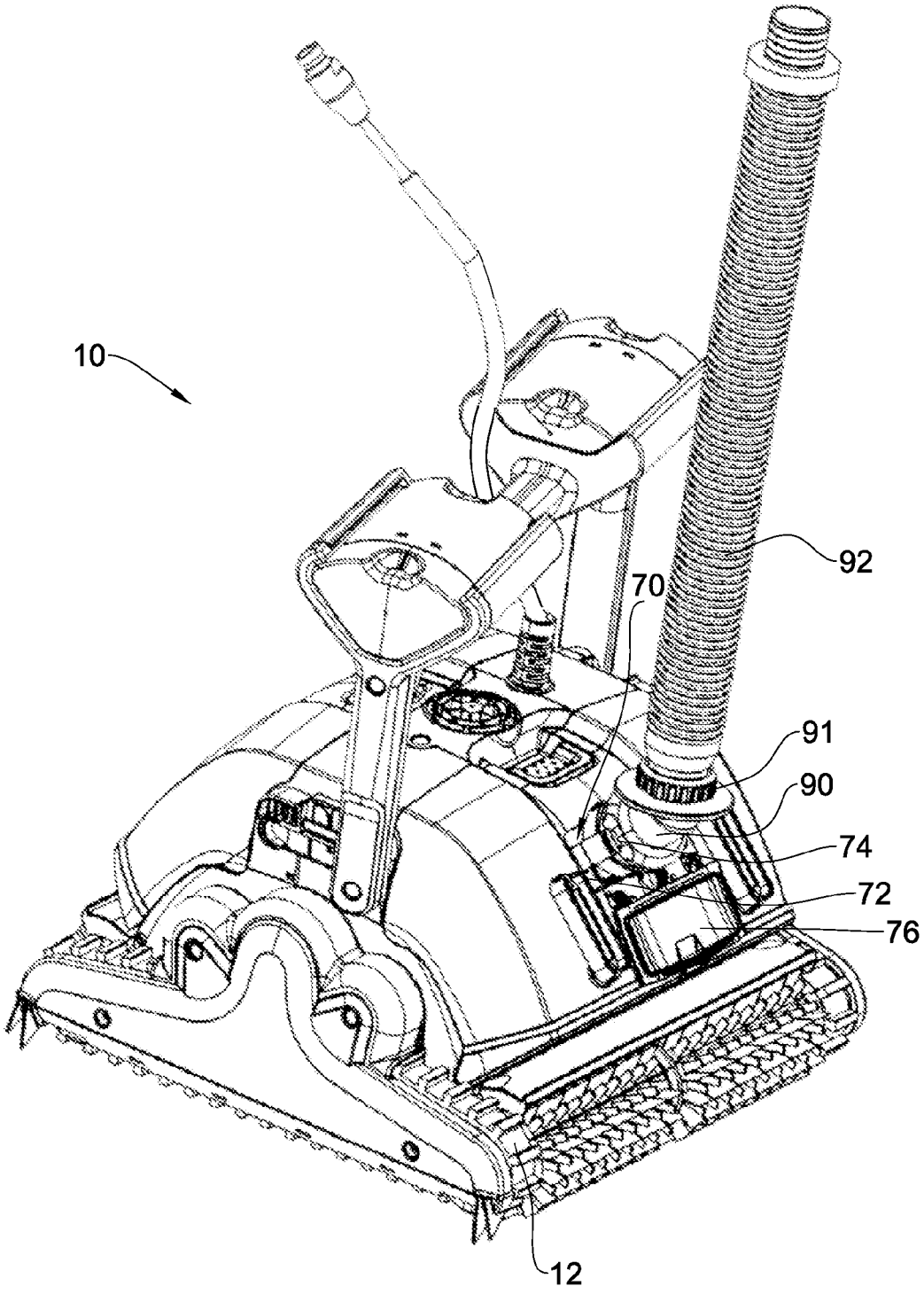
FIG. 5 schematically illustrates a perspective view of a pool cleaning robot according to the presently disclosed subject matter, ready for connection or connected to an external suction and filtering system.
Figure 6:
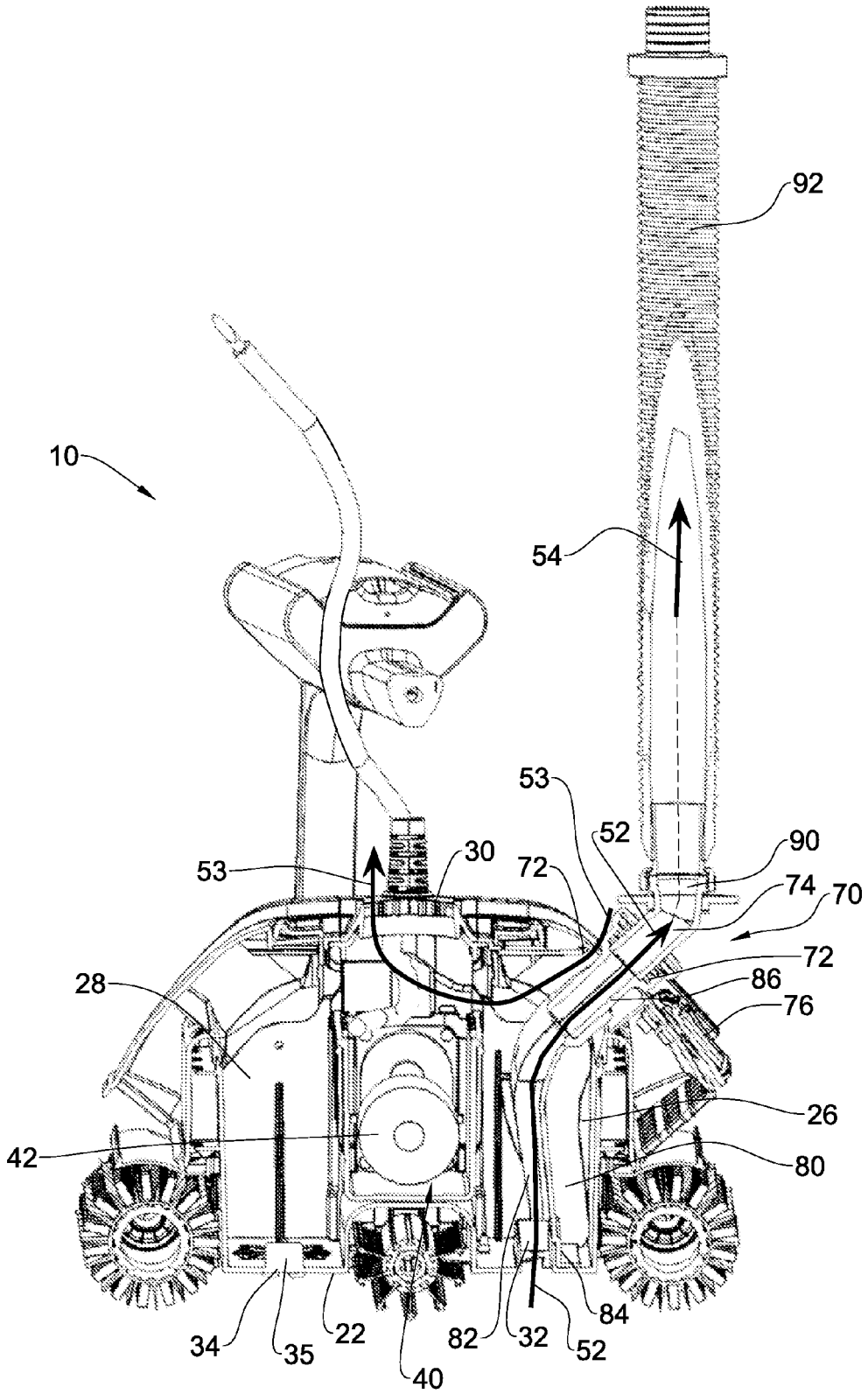
FIG. 6 schematically illustrates a cross-sectional view of a pool cleaning robot according to the presently disclosed subject matter, ready for connection or connected to an external suction and filtering system.

Referring to FIGS. 5 and 6, the first cover 21 of the housing top surface 24 comprises an additional inlet 72 and an additional outlet 74 which are disposed at a common opening 70 formed therein. The opening 70 can be opened and closed by a door 76, which is shown in its closed position in FIGS. 1 and 2, and in its opened position in FIGS. 5 and 6.

The additional outlet 74 is used for pumping water with debris from an area underneath the housing bottom 22 to the external suction and filtering system. When the water with debris is received within the external suction and filtering system, it is filtered therein and clean water is returned to the pool.

In order to deliver and pump the water with debris to the external suction and filtering system, the first bottom inlet 32 is used for a second fluid communication with the additional outlet 74 via a second fluid path 52 (which is different from the first fluid path 51). The second fluid path 52 constitutes a part of an external suction and filtering fluid path 54 which is created when the additional outlet 74 is fluidly connected to the external suction and filtering system.

Following the extraction of the filter units 27 and 29 from their filter compartments (shown in FIG. 4), the door 76 is opened, and an adapter unit 80 (shown in FIGS. 6 and 7) is inserted into the first filter compartment 26. The adapted unit 80 has an interior portion which is configured to fluidly interconnect between the additional outlet 74 and the bottom inlet 32, thereby constitute a part of the second fluid path 52. When the second fluid path 52 is established by the adapter unit 80, the first fluid path 51 has to be totally cancelled. Therefore, additionally to the extraction of the filter units 27 and 29 from their filter compartment, the second bottom inlet 34 has to be sealed so as to prevent entrance of water into the second filter compartment 28. This sealing is performed by inserting a sealing member 35 (shown in FIGS. 6 and 8) into the second bottom inlet 34.

Figure 7:
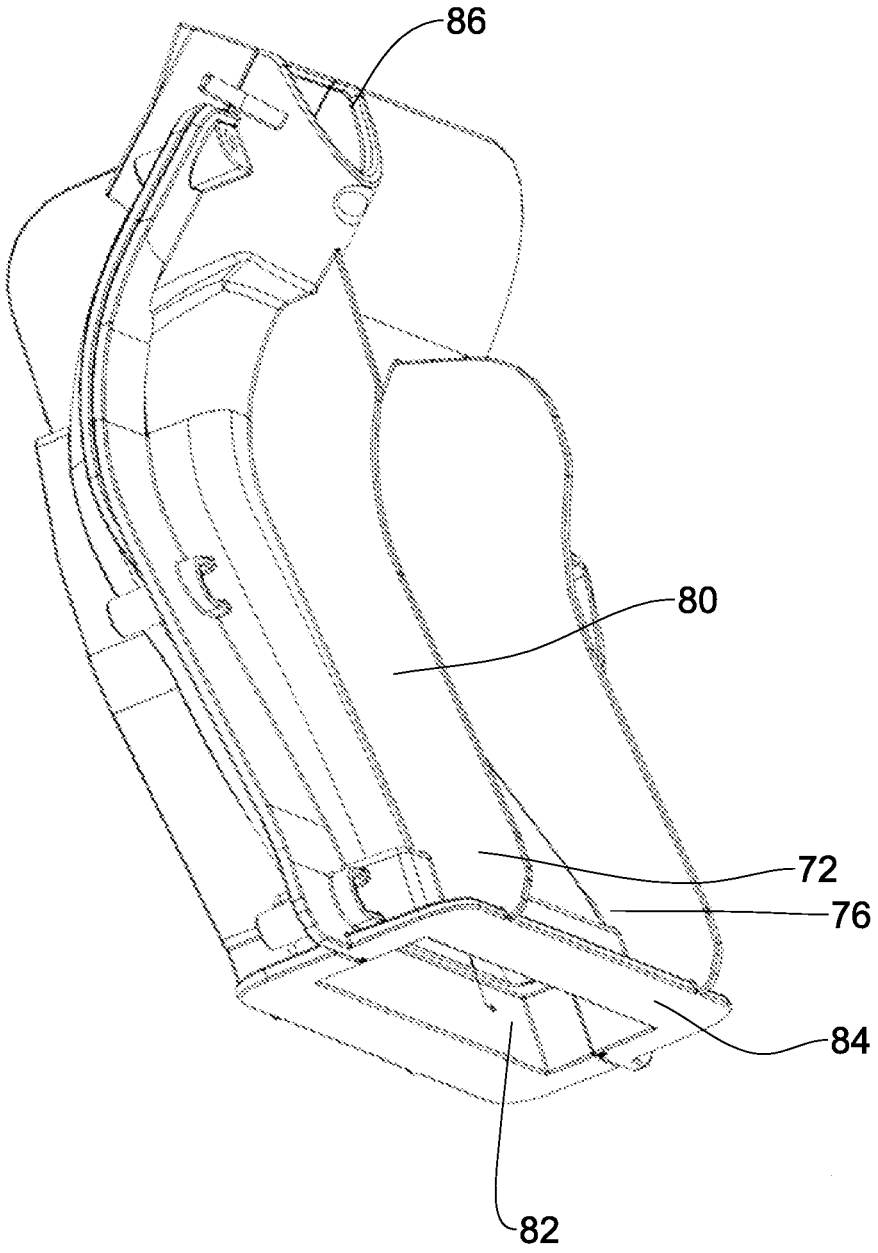
FIG. 7 schematically illustrates an adapter unit of a pool cleaning robot according to the presently disclosed subject matter.
Figure 8:
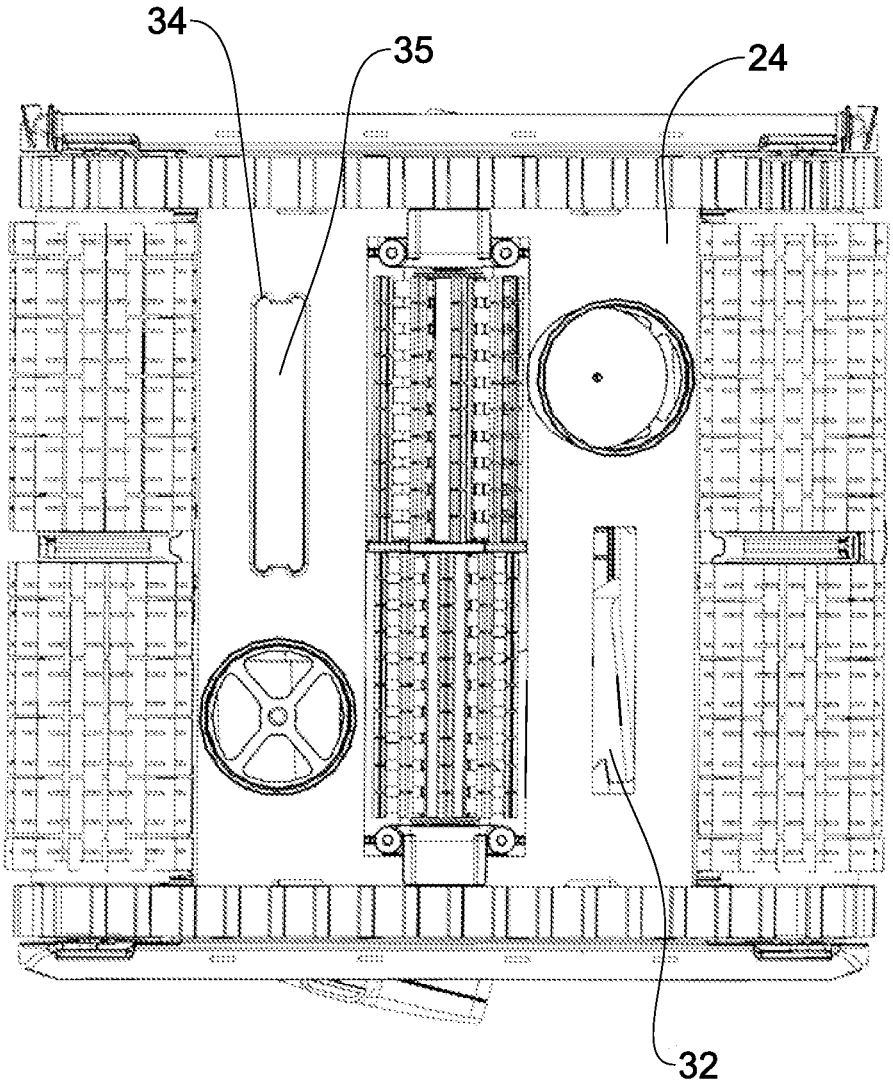
FIG. 8 schematically illustrates a bottom view of a pool cleaning robot according to the presently disclosed subject matter, ready for connection or connected to an external suction and filtering system.

The reference to FIGS. 6 and 7, the adapter unit 80 has a first end 84 and a second end 86 which are disposed at opposite ends of the interior portion 82. When the adapter unit 80 is mounted within the first filter compartment 26, its first end 84 is fluidly connected to the first bottom inlet 32, and its second end 86 is fluidly connected to the additional outlet 74. More specifically, the second end 86 of the adapter unit 80 is connected via the additional outlet 74 to a hose adapter 90 which fluidly interconnects between the second end 86 and a hose 92. In operation, the hose 92 is connected to the external suction and filtering system for drawing water and debris from the first bottom inlet 32 to the external suction and filtering system via the adapted unit 80. The hose adapter 90 includes a swivel mechanism 91 configured for preventing swivel of the hose 92 around itself.

When the external suction and filtering system is used, the robot still has to be proximal to the pool's surface (as when the internal filtering system is used) by using a thrust force in order to perform its intended cleaning operation of cleaning the pool's floor and to be able to climb on the pool's wall and cleaning it. For this task, when the adapted unit 80 is disposed within the first filter compartment, and the door 76 is opened, a third fluid communication is generated along a third fluid path 53 which is defined between the additional inlet 72 and the impeller outlet 30. The third fluid path 53 is used for introducing water from the sides of the robot and extracting it via the impeller outlet 30, thereby generating the thrust force that biases the robot 10 toward the surface of the pool. During operation, the impeller motor is operated for rotating the impeller 44 and the motors 12 are operated for rotating the tracks 12 which are responsible for the movement of the robot and rotation of its brushes 14 and 15. This operation of the impeller 44 causes the water to be drawn into to robot via the third fluid path 53. While the motors 42 are operated for moving the robot along the pool's surface, and the impeller motor is used for rotating the impeller 44 for generating the thrust force which keeps it proximal the pool's surface, the external suction and filtering system pumps water and debris via the second fluid path and filters it.

This simultaneous operation provides two opposite directions of fluid flow in the opening 70: one fluid flow via additional outlet 74 towards the external suction and filtering system, and another opposite flow via the additional inlet 72, disposed around the additional outlet 72, into the interior of the robot. In should be mentioned that when the internal filtering system is used, the door 76 has to be closed for preventing entrance of water via the opening 70, and when the external suction and filtering system is used, the door 70 has to be opened for allowing the second and third fluid communications, thereby creating the second and the third fluid paths.

As explained above, the robot 10 is configured for cleaning a pool by used an internal of an external suction and filtering system. For choosing which filtering system will be used, the robot 10 has an arrangement that converts is operation between the internal and the external suction and filtering systems, thereby between the first fluid path and the second with the third fluid paths. In order to use the external suction and filtering system instead of the internal filtering system, the following steps have to be performed:

a. The filter units 27 and 29 have to be extracted from their filter compartments, and the second bottom inlet 34 has to be sealed, for cancelling the first fluid path 51; and
b. The adapter unit 80 has to be accommodated within the first filter compartment 26 for defining the second and the third fluid paths 52 and 53 instead of the first fluid path 51.

In order to use the internal filtering system instead of the external suction and filtering system, the following steps have to be performed:

a. The adapter unit 80 has to be extracted out of the first filter compartment 26 for cancelling the second and the third fluid paths 52 and 53, and the second bottom inlet 34 has to be opened; and
b. The filter units 27 and 29 have to be accommodated within their filter compartments, so as to create the first fluid path 51.

In both cases of using the internal filtering system or the external suction and filtering system, the motors of the robot, and/or its controller may not know which filtering system is used, because in both cases the motors of robot which are responsible with its movement and for the rotation of the impeller may continue to operate at the same manner indifferently which filtering system is used.

When the robot 10 is connected to the external suction and filtering system, its ability to provide passage of water with debris without passing through the impeller via the first fluid path, is an advantage due to the tendency of large debris to be stuck within the impeller and to risk its operation. Thus, the fact that second fluid path is not in fluid communication with the impeller, prevents this risk. Another advantageous feature of the robot of the presently disclosed subject matter is its ability the continue operating the impeller for generating a thrust force that biases the robot 10 toward the surface of the pool by using the third fluid path, independently and simultaneously to the passage of fluid with debris via the second fluid path to the external suction and filtering system. This operation of the impeller can, for example, ensure that the robot will not be disconnected from the wall of the pool when climbing on it.

Figure 9:
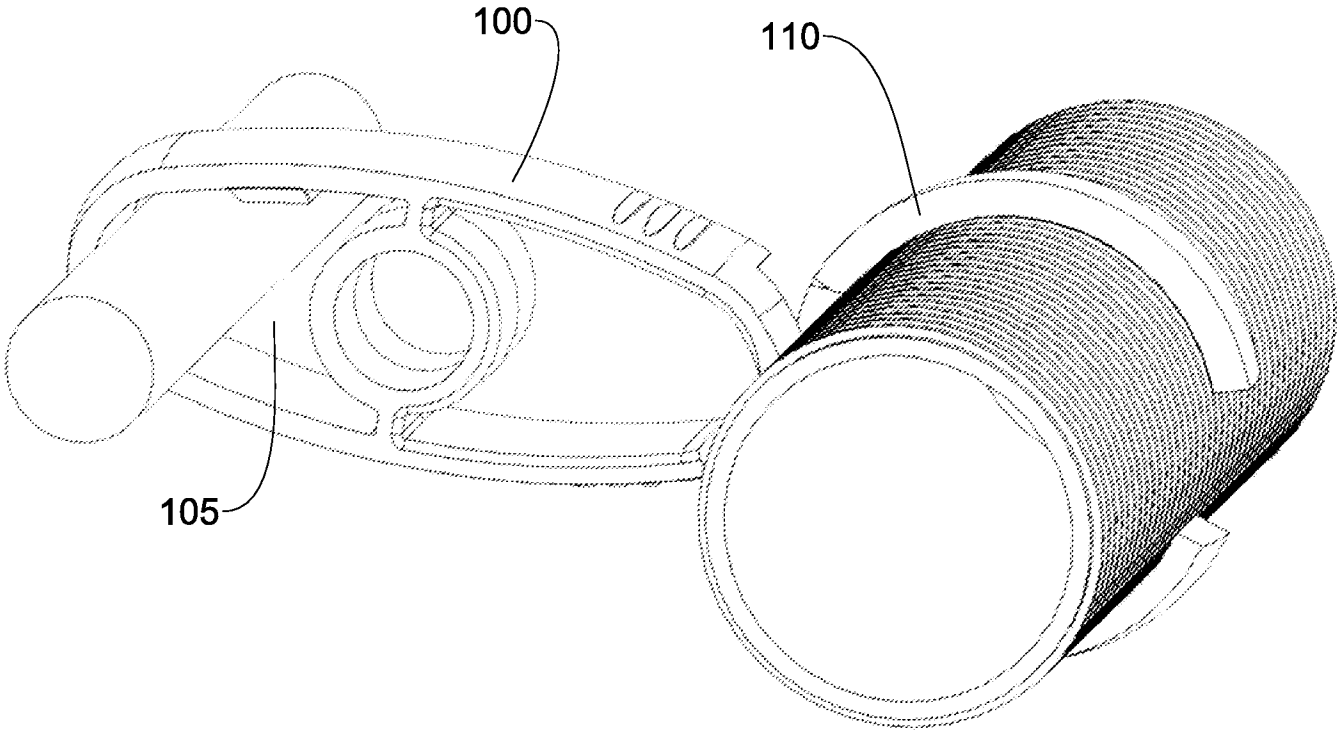
FIG. 9 schematically illustrates a perspective view of a holder configured holding an electric cable of the robot and a hose connected to the robot in proximity to each other.

Reference is now made to FIG. 9, which schematically illustrates a holder 100 having configured for holding the electric cable 41 and the hose 92 in proximity to each other. A plurality of holders 100 can be used for holding the electric cable 41 and the hose 92 together. The holder 100 comprises: an aperture 105 configured for allowing insertion of the electric cable 41 therethrough and free rotation of this cable therein; and a grasper 110 configured for detachably attaching to the hose 92. During movement of the robot within the pool, the hose 92 will no swivel within the grasper 110 due to the swivel mechanism 91 and a strong gripping of the hose 92 by the grasper 110.

Figure 10:
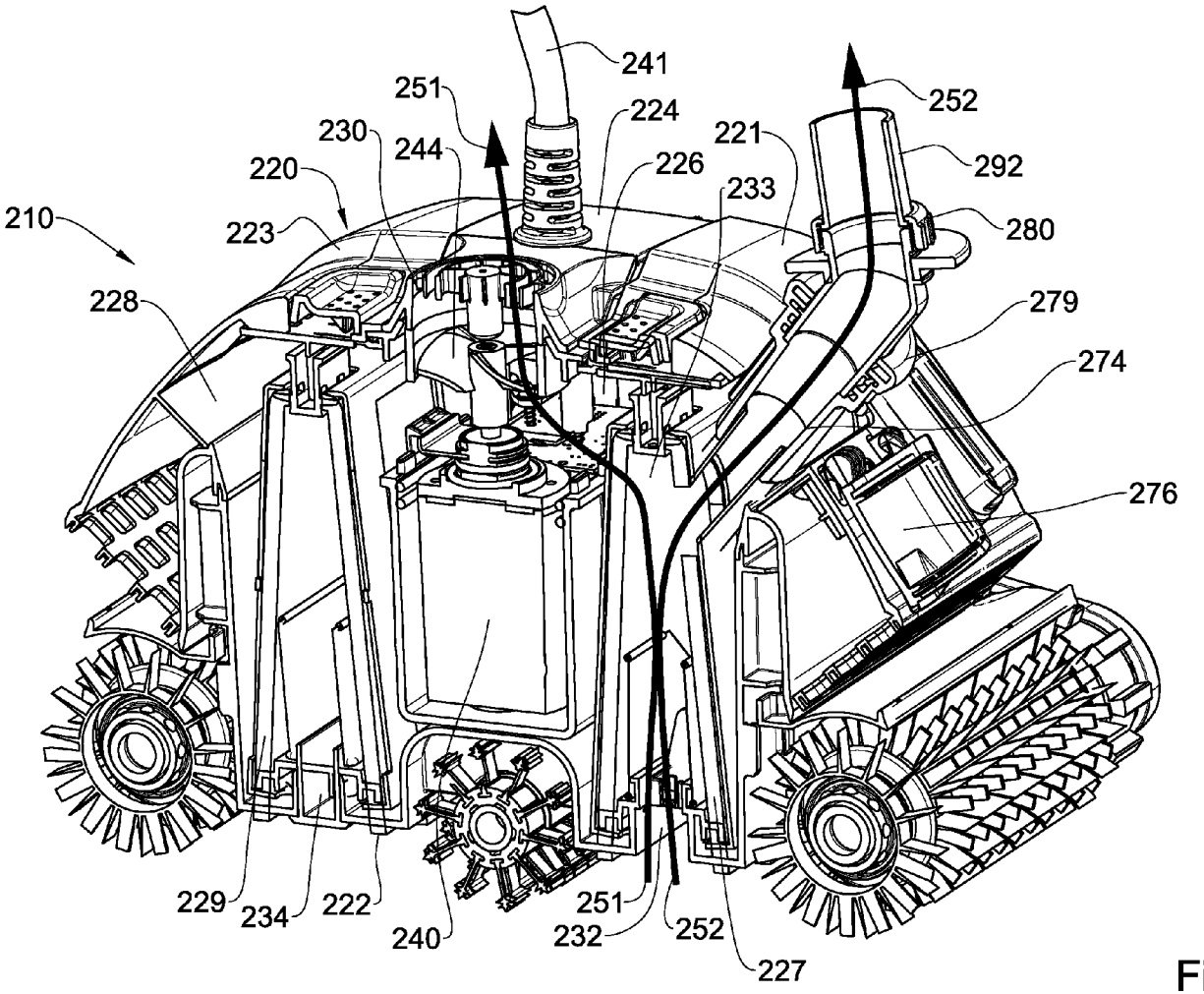
FIG. 10 schematically illustrates a perspective view of a pool cleaning robot configured for cleaning a pool by an internal filtering system and having an ability to provide extraction of debris collected therein by an external suction and filtering system.

Reference is now made to FIG. 10 which schematically illustrates a pool cleaning robot, which is generally indicated at 210. The robot 210 is configured to clean the pool by using an internal filtering system, as it is explained below. In addition to this ability, the robot is also configured to allow extraction of debris that is collected in the internal filtering system, by using an external suction and filtering system, as detailed below.

The robot 210 comprises a housing 220 which has a housing bottom 222 and a housing top surface 224 having a first cover 221 and a second cover 223, and a driving unit 240 having an impeller 244 which is connected to an impeller motor (not shown) that rotates the impeller in operation.

The housing 220 also includes a first filter compartment 226 and a second filter compartment 228 formed therein, such that the driving unit 240 is disposed therebetween.

The driving unit 240 is sealably disposed within the housing 220, and can be operated by being connected to an electric power source (not shown) via an electric cable 241. The driving unit 240 also includes a main controller (not shown) which can be programmed to control the operation of the robot, and specifically the operation of the robot's motors. For example, the main controller can be programmed to perform scanning of the pool according to one of several algorithms.

As shown in FIG. 10, each of the filter compartments 226 and 228 accommodates a first filter unit 227 and a second filter unit 229, correspondingly. The first and the second filter units 227 and 229 constitute a part of the internal filtering system by filtering the pool's water which passes therethrough while being pumped by the impeller 244. The filter units 227 and 229 are made of a rigid frame, and can be extracted from the robot 210 for cleaning, replacement, and for using the external suction and filtering system instead of the internal filtering system.

The housing 210 further includes an impeller outlet 230 which is formed in the housing top surface 224, and a first and second bottom inlets 232 and 234 which are formed in the housing bottom 222. As shown in FIG. 10, the first and the second bottom inlets 232 and 234 are in fluid communication with the first and the second filter compartments 226 and 228, and with the first and the second filter units 227 and 229, correspondingly. In the configuration of the robot 210, in which the internal filtering system is used, the first and the second bottom inlets 232 and 234 are in a first fluid communication with the impeller outlet 230 via the first and the second filter units 227 and 229, correspondingly, thereby defining a first fluid path 251.

During operation of the robot 210, when the internal filtering system is used, the impeller 244 which is operated by the impeller motor, draws water and debris from the floor or sidewall of the pool via the first fluid path 251, i.e., from the first and the second water inlets 232 and 234 through the first and the second filters 227 and 229 towards the impeller outlet 230. The clean water is expelled through the impeller outlet 230. In addition to facilitating the cleaning of the pool, this process generates a thrust force that biases the robot 210 toward the surface of the pool. This thrust force keeps the robot proximal to the pool's surface to as to clean the pool's floor and to climb on the pool's wall and clean it.

In addition to the above description of the robot's 220 operation for cleaning the pool by the internal filtering system, it can be fluidly connected to an external suction and filtering system for simultaneously and/or independently extracting the debris that is collected in the filter unit(s) of the internal filtering system. This operation of the external suction and filtering system can be used for emptying the filter unit(s) of the internal filtering system without extracting the robot 220 from the pool and without extracting the filter unit(s) from the robot in order to clean them. For providing this, the filter unit 227 has a filter unit interior 233 a part of which constitutes a part of the first fluid path 251 and also a part of a second fluid path 252. The second fluid path 252 is defined between the first bottom inlet 232, the filter unit interior 233, a filter unit opening 265, an additional outlet 274, a hose 292, and an external suction and filtering system (not shown).

In order to empty the filter unit 227 from the debris collected therein, the second fluid path 252 can be established by opening a door 276, connecting a hose adapter 279 to the filter unit opening 265 in the additional outlet 274, and connecting the hose 292 to the hose adapter 279. The hose adapter 279 includes a swivel mechanism 280 which is configured for preventing swivel of the hose 292 around itself. When the second fluid path 252 is established, the external suction and filtering system can be activated when needed for drawing the debris from the filter unit 227. This operation of the external suction and filtering system can be performed simultaneously to the operation of the internal filtering system, and also when the internal filtering system is inoperative. In other words, according to one example of operation, the robot can clean the pool via the first fluid path while debris is extracted therefrom via the second fluid path by the external suction and filtering system, at the same time (in parallel). According to another example of operation, the robot can be in an inoperative state (non-cleaning state), while the debris is extracted therefrom via the second fluid path by the external suction and filtering system.

It should be emphasized that according to the example of FIG. 10 in which the first and the second fluid paths are established, the third fluid path which is disclosed above with reference to FIGS. 1 to 9, is obstructed, so that there is no fluid communication between the additional inlet, and the impeller outlet that are defined above.

According to one example, the external suction and filtering system can be one integrated unit which collects the debris from the robot 10 by pumping it, filters the water from the debris, and return the filtered water to the pool. According to another example, the external suction and filtering system can be divided to two parts: a first part (e.g., a debris collecting bag) that collects the massive debris (e.g., leaves) from the filter unit(s) of the robot, and a second part that is responsible for the suction of the debris from the robot, and optionally filtration of the water and returning it to the pool.

The above described operation of the external suction and filtering system for emptying the filter unit of the robot 210 can be controlled by a timer (not shown) that is preprogrammed to be operated according to predetermined sequences of time.

The advantage of the above described ability to empty to robot's 210 filter unit(s) by the external suction and filtering system allows to leave the robot 210 in the pool for long periods of time (e.g., in the winter) without the need to extract it from the pool each time for cleaning its filter unit(s). This results in a much easier operation of the robot for cleaning its filter units.

Those skilled in the art to which this invention pertains will readily appreciate that the embodiments described above are only examples of the presently disclosed subject matter and that numerous changes, variations, and modifications can be made thereto.

The invention claimed is:

1. A pool cleaning robot comprising:

a housing having a housing bottom and a housing top surface;

an impeller and a motor configured to operate the impeller, both mounted within the housing;

a first filter compartment formed within said housing configured for accommodating a first filter unit therein;

an impeller outlet formed in said housing top surface;

a first additional outlet other than the impeller outlet formed in said housing top surface and configured for being fluidly connected to an external suction and filtering system;

a first bottom inlet formed in said housing bottom configured for a first fluid communication with the impeller outlet via said first filter unit, thereby defining a first fluid path;

a second bottom inlet formed in said housing bottom configured for a second fluid communication with said first additional outlet via a second fluid path at least partially different from the first fluid path, said second fluid path constituting a part of an external suction and filtering fluid path created when said additional outlet is fluidly connected to the external suction and filtering system;

a hose adapter configured for fluidly connecting said first additional outlet to a hose connectable to said external suction and filtering system;

wherein said pool cleaning robot is operated by an electric supply source via an electric cable, and comprises a holder configured for holding said electric cable and said hose in proximity to each other and preventing their swivel around each other;

wherein the holder comprises an aperture for allowing insertion of said electric cable therethrough and free rotation of said cable therein and a grasper configured for detachably attaching to said hose.

2. The pool cleaning robot according to claim 1, wherein the pool cleaning robot further comprising an arrangement for selecting or mixing between the first fluid communication and the second fluid communication.

3. The pool cleaning robot according to claim 2, wherein said second filter compartment is parallel to said first filter compartment.

4. The pool cleaning robot according to claim 3, wherein said interior portion of the adapter unit is disposed between a first and a second end of the adapter unit, the first end of the adapter unit being configured for fluidly communicating with said second bottom inlet, and the second end of the adapter unit being configured for fluidly communicating with said first additional outlet.

5. The pool cleaning robot according to claim 2, further comprising a main controller configured to control the operation of said motor during operation of the robot via the first fluid path, and during operation of the pool cleaning robot via a combination of the second and the third fluid paths.

6. The pool cleaning robot according to claim 1, wherein the hose adapter includes a swivel mechanism configured for preventing swivel of said hose around itself.

7. The pool cleaning robot according to claim 1, further comprising a second additional inlet formed in said housing top surface and configured for a third fluid communication with the impeller outlet, thereby defining a third fluid path.

8. The pool cleaning robot according to claim 7, wherein said third fluid communication is configured to generate a thrust force that biases said housing toward a pool surface which the housing bottom faces during operation of the robot.

9. The pool cleaning robot according to claim 7, wherein said pool cleaning robot is configured to be operated via at least one of the first, second and the third fluid communications.

10. The pool cleaning robot according to claim 9, wherein said second additional inlet is configured for being opened and closed for allowing and preventing said third fluid communication, respectively.

11. The pool cleaning robot according to claim 7, wherein said second additional inlet and second additional outlet are disposed at a common opening formed within the housing top surface.

12. The pool cleaning robot according to claim 11, wherein said common opening comprises a door configured for allowing and preventing said second and third fluid communication by being opened and closed, correspondingly.

13. The pool cleaning robot according to claim 11, wherein said second additional inlet is formed at said common opening around said second additional outlet.

14. The pool cleaning robot according to claim 7, wherein said pool cleaning robot is configured for climbing of a sidewall of the pool during operation of the pool cleaning robot via the first fluid path, and during operation of the pool cleaning robot via a combination of the second and the third fluid paths, when the biasing contributes to the pool cleaning robot to be in contact with the sidewall of the pool.

15. The pool cleaning robot according to claim 1, wherein said first fluid communication is additionally configured to generate a thrust force that biases said housing toward a pool surface which the housing bottom faces during operation of the robot.

16. The pool cleaning robot according to claim 1, further comprising a driving unit having at least one electric motor configured for moving said pool cleaning robot within the pool.

* * * * *